US007343718B2

(12) United States Patent
Foust et al.

(10) Patent No.: US 7,343,718 B2
(45) Date of Patent: Mar. 18, 2008

(54) METHOD FOR MAKING MULTIPLE-PART CONCRETE POLE

(75) Inventors: Earl R. Foust, Birmingham, AL (US); Wesley J. Oliphant, Tomball, TX (US); Fouad H. Fouad, Birmingham, AL (US); Kenneth L. Sharpless, Mansfield, TX (US)

(73) Assignee: Newmark International, Inc., Birmingham, AL (US)

( * ) Notice: Subject to any disclaimer, the term of this patent is extended or adjusted under 35 U.S.C. 154(b) by 353 days.

(21) Appl. No.: 10/768,543

(22) Filed: Jan. 30, 2004

(65) Prior Publication Data

US 2004/0211148 A1 Oct. 28, 2004

Related U.S. Application Data

(60) Division of application No. 09/977,565, filed on Oct. 15, 2001, now Pat. No. 6,705,058, which is a continuation-in-part of application No. 09/450,871, filed on Nov. 29, 1999, now abandoned.

(60) Provisional application No. 60/119,871, filed on Feb. 12, 1999.

(51) Int. Cl.
*E04C 3/34* (2006.01)
*B28B 1/20* (2006.01)

(52) U.S. Cl. ..... 52/745.17; 52/223.4; 52/721.2; 264/228; 264/310; 425/111

(58) Field of Classification Search ..... 52/167.1, 52/223.4, 295, 720.1, 721.2, 721.4, 723.1, 52/736.1, 736.3, 742.14, 741.14, 745.17; 264/35, 228, 310; 425/111, 126, 289, 137.1
See application file for complete search history.

(56) References Cited

U.S. PATENT DOCUMENTS

| | | | |
|---|---|---|---|
| 301,108 | A | 7/1884 | Furness |
| 411,204 | A | 9/1889 | Short |
| 595,600 | A | 12/1897 | Buck |
| 689,387 | A | 12/1901 | Crossland |
| 732,223 | A | 6/1903 | Rhoades |

(Continued)

FOREIGN PATENT DOCUMENTS

| | | |
|---|---|---|
| DE | 426 074 | 3/1926 |
| DE | 705891 | 5/1941 |
| DE | 2 255 713 | 5/1974 |
| DE | 3440531 | 3/1986 |
| EP | 876891 | 11/1942 |
| EP | 1162522 | 9/1958 |

(Continued)

OTHER PUBLICATIONS

Dana R. Crissey and Richard S. Benson, "Steel and Concrete Combined", Transmission & Distribution, Sep. 2000 Intertec Publishing, Overland Park, KS US.

*Primary Examiner*—Winnie Yip
(74) *Attorney, Agent, or Firm*—Theresa Fritz Camoriano; Camoriano and Associates

(57) ABSTRACT

This invention relates to pole structures used for supporting transmission and distribution lines, lighting and communications systems, highway signs, traffic signals, and the like. More specifically, this invention relates to a new and useful design of a multi-sectioned pole, with at least one telescoping upper section made of metal or another similar lightweight material and a base section composed of concrete or similar material that can be directly embedded into the ground without the need for baseplate-type foundations, or other preparatory work.

4 Claims, 9 Drawing Sheets

U.S. PATENT DOCUMENTS

| | | | | | |
|---|---|---|---|---|---|
| 839,272 | A | | 12/1906 | Crow | |
| 976,879 | A | | 11/1910 | Hughs | |
| 1,244,652 | A | | 10/1917 | Southgate | |
| 1,329,026 | A | | 1/1920 | Snyder | |
| 1,542,575 | A | | 6/1925 | Perry | |
| 1,567,301 | A | | 12/1925 | Ross | |
| 1,679,297 | A | | 7/1928 | Ehrler | |
| 1,712,757 | A | | 5/1929 | Erskine | |
| 1,819,733 | A | | 8/1931 | Castelli | |
| 2,036,771 | A | | 4/1936 | Pfistershammer | |
| 2,040,010 | A | | 5/1936 | McMahon | |
| 2,764,670 | A | | 9/1956 | Van Dusen, Jr. | |
| 2,792,947 | A | | 5/1957 | Weedman | |
| 3,403,520 | A | | 10/1968 | Goodman | |
| 3,429,129 | A | | 2/1969 | Johansson et al. | |
| 3,592,243 | A | * | 7/1971 | Fukushima et al. | 140/92.2 |
| 3,638,433 | A | | 2/1972 | Sherard | |
| 3,713,262 | A | | 1/1973 | Jatcko | |
| 3,738,786 | A | * | 6/1973 | Van Buren | 425/111 |
| 3,838,547 | A | | 10/1974 | Meisberger | |
| 3,865,498 | A | | 2/1975 | Okuto et al. | |
| 3,911,548 | A | | 10/1975 | Perry | |
| 3,958,381 | A | | 5/1976 | Meyer | |
| 3,991,532 | A | | 11/1976 | Buxbom | |
| 4,033,080 | A | | 7/1977 | Fukushima | |
| 4,092,079 | A | | 5/1978 | Swanson | |
| 4,166,347 | A | * | 9/1979 | Pohlman et al. | 52/223.4 |
| 4,246,732 | A | | 1/1981 | Frehner | |
| 4,492,496 | A | | 1/1985 | Arnold | |
| 4,522,579 | A | * | 6/1985 | Rotondo et al. | 425/126.1 |
| 4,617,768 | A | | 10/1986 | Gebelius | |
| 4,673,157 | A | | 6/1987 | Wells | |
| 4,751,804 | A | * | 6/1988 | Cazaly | 52/721.2 |
| 4,779,389 | A | | 10/1988 | Landers | |
| 4,813,199 | A | | 3/1989 | Lewis, Jr. | |
| 4,930,270 | A | | 6/1990 | Bevacqua | |
| 5,055,987 | A | | 10/1991 | Ellson et al. | |
| 5,076,032 | A | | 12/1991 | Lehman | |
| 5,249,112 | A | | 9/1993 | Bray | |
| 5,285,614 | A | | 2/1994 | Fouad | |
| 5,398,478 | A | | 3/1995 | Gordin et al. | |
| 5,667,744 | A | * | 9/1997 | Valle et al. | 264/225 |
| 5,761,875 | A | * | 6/1998 | Oliphant et al. | 52/721.2 |
| 5,784,851 | A | | 7/1998 | Waugh | |
| 6,092,341 | A | * | 7/2000 | Yamashita et al. | 52/167.1 |
| 6,167,673 | B1 | | 1/2001 | Fournier | |
| 6,408,590 | B1 | | 6/2002 | Cote | |
| 6,453,636 | B1 | | 9/2002 | Ritz | |

FOREIGN PATENT DOCUMENTS

| | | | |
|---|---|---|---|
| EP | 82 20352 | | 11/1982 |
| GB | 717699 | | 11/1954 |
| GB | 862350 | | 3/1961 |
| JP | 2-295705 | * | 12/1990 |
| JP | 5-16130 | * | 1/1993 |
| JP | 6-63672 | * | 3/1994 |

* cited by examiner

METHOD FOR MAKING MULTIPLE-PART CONCRETE POLE

This application is a divisional of U.S. patent application Ser. No. 09/977,565, filed Oct. 15, 2001 now U.S. Pat. No. 6,705,058, which is a continuation-in-part of U.S. patent application Ser. No. 09/450,871, filed Nov. 29, 1999 now abandoned, which claims priority from U.S. Provisional Application Ser. No. 60/119,871, filed Feb. 2, 1999.

BACKGROUND OF THE INVENTION

It is known in the art of pole manufacturing that the suitability of a pole for a given purpose depends upon the materials from which it is constructed. Pole designs have been restricted by the fact that selection of the material for construction previously required a tradeoff with respect to a number of certain key desirable characteristics of the pole. Among the key characteristics are strength, resilience, weight, length, durability, resistance to environmental conditions, and the ease of transportation and erection. Optimal pole design has been confounded because materials which provide superiority in one characteristic generally have corresponding disadvantages in other characteristics.

Perhaps the oldest known method in the art of pole construction is the use of wooden poles, such as those commonly used for telephone lines. However, many modern pole uses require longer lengths than are practical, or even possible, with wood. While shorter length poles constructed of wood are relatively inexpensive and easy to erect, wood poles become increasingly more expensive as the desired length increases. Furthermore, wood poles are highly susceptible to rot, insect infestation, and bird attack. Known methods of preventing these latter problems present their own difficulties in that the chemicals used to treat the wood may leach out into the surrounding soil, causing environmental hazards. Finally, optimal construction of wooden poles requires that the pole be of one piece of uncut wood. This creates difficulties in transporting and erecting long poles, and it obviously limits the maximum pole length to the height of available trees from which the poles are made.

Metal pole construction has also long been known in the art. However, metal poles also have disadvantages. Although relatively strong and capable of being constructed in sections for ease of transportation and erection, metal poles have limited durability in that they are susceptible to rusting and other chemical deterioration. This is primarily because the moisture, chemicals, and abuse that a typical pole receives at its base abrade any resistant coatings and lead to rapid rusting and deterioration of the metal structure. Metal poles experience an acute problem in locations near roadways, marine environments, industrial plants, and aggressive soils. For example, the salt used to prevent ice accumulation on the roads inevitably comes into contact with the pole, accelerating its deterioration. Other chemicals commonly spilled onto roadways can easily be splashed onto metal poles, accelerating the deterioration. Marine environments are also very aggressive and substantially limit the life of a metal pole.

Further, metal poles implanted directly into the ground or with closely surrounding vegetation are subjected to constant moisture accumulation both underground and within the first few feet of the base. While separately preparing a foundation onto which a metal pole may be secured addresses the underground deterioration, this does not solve the problem of salt and chemical splash, abuse, or moisture at the ground line vicinity of the pole. Further, such foundations built on site have the disadvantage of being of variable quality depending on the skill of the designer, the worker, and the actual soil conditions. Likewise, the necessity for the design and construction of a separate foundation structure adds significantly to the time and expense required to erect such a pole. Attachment to such foundation presents a critical structural weak point. Bolts used for attachment of the pole to the base are themselves subject to environmental degradation. Additionally, the bolts and mechanical fasteners represent a weak point because of the imposed fatigue loads and thus the potential for failure in shear or tension. The bolts may also pull out under stress if they are not adequately embedded in the foundation.

The use of concrete poles has also been known in the prior art. The strength and durability of concrete poles is superior to other materials. Concrete poles also solve the problem of susceptibility to roadside conditions and moisture. However the greater weight of concrete poles precludes the use of very long poles. The weight causes problems both for transportation and for ease of installation. Methods have been devised for transporting concrete poles to the construction site in sections to address the weight problem. See, for example, U.S. Pat. No. 5,285,614 issued to Fouad, which is hereby incorporated by reference, and which describes a splicing mechanism for concrete poles to address the weight and length restrictions. However, the greater weight of concrete poles has significantly impeded their widespread use.

A new improvement in the art is the use of hybrid pole construction, where the advantages of two different types of poles can be utilized. However, a hybrid pole approach has engendered its own set of problems, not the least of which is the method for securing the upper steel or other lightweight material pole to the concrete base pole and the method for manufacturing the pole in a manner that permits the pole to support high loads while reducing pole weight. The most efficient way to manufacture a strong concrete pole is by centrifugally casting the pole. The centrifugal action compacts the concrete mix, making it denser and thus stronger. The hollow core results in a lighter weight pole as well as saving on the cost of raw materials. The smooth, circular cross-section of the concrete base pole makes it easier to embed into the ground, is the most efficient shape for wind-loading minimization, and is the easiest to centrifugally cast. A lightweight, hollow steel or other lightweight material upper pole, on the other hand, generally is stronger and provides greater torsion resistance if it has a multisided cross-section than if it has a circular cross-section. So far, there has been no pole design that takes advantage of all the most favorable characteristics of both types of materials in a hybrid construction.

SUMMARY OF THE INVENTION

It is an object of one preferred embodiment of this invention to provide a centrifugally-cast concrete pole base that is reinforced, prestressed, and post-tensioned and that has two different cross-sectional shapes in order to permit it to readily receive a multi-sided upper pole section. This permits the mounting of much taller metal, fiberglass, or other material poles on the concrete pole base in one or more pole sections so as to reach the desired height while utilizing all the best design characteristics of each individual material.

It is also an object of the present invention to provide for taller poles that are economical to manufacture and install, in terms of time, labor, and materials.

DESCRIPTION OF THE PREFERRED EMBODIMENTS

Figure 1:
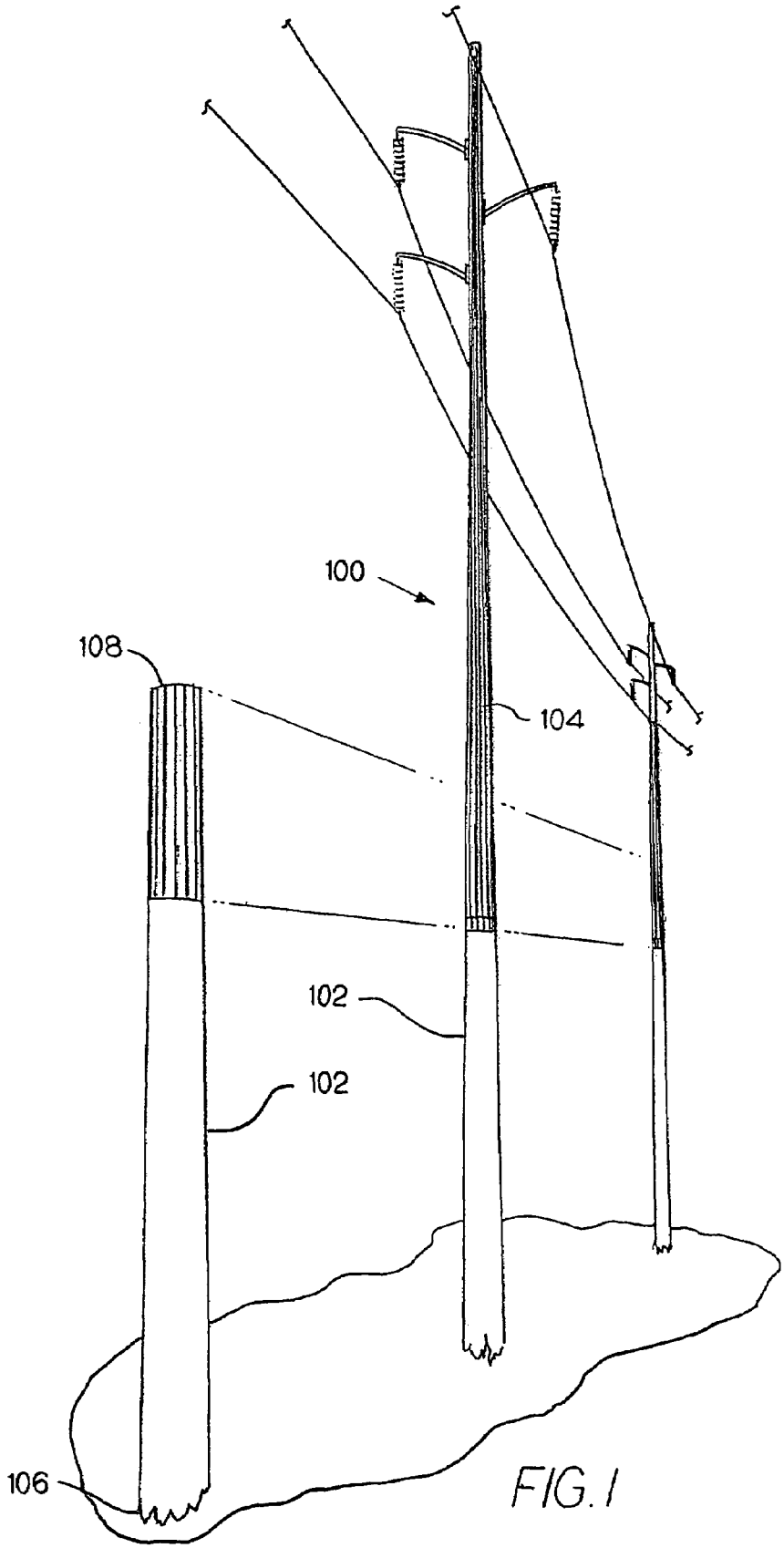
FIG. 1 is a perspective view of a preferred embodiment of a hybrid pole made in accordance with the present invention, where the pole in the foreground depicts the concrete base section only, and the other two poles are completely constructed.
Figure 2:
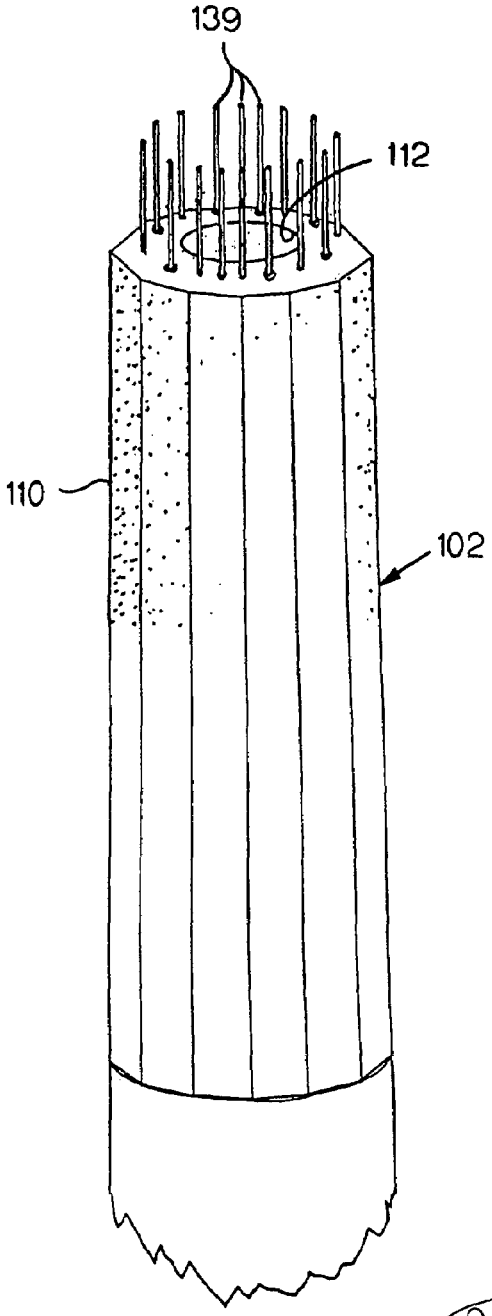
FIG. 2 is an enlarged, broken away perspective view of the upper portion of the concrete base of FIG. 1 after removal from the manufacturing molds and before the reinforcing post-tensioning strands have been tensioned.

FIGS. 1-4 show a first preferred embodiment of a hybrid construction pole 100 made up of a concrete base pole 102, and a hollow, multi-sided metal pole section 104 mounted atop and overlapping part of the concrete base pole 102. The concrete base pole 102 defines a first or lower end 106 and a second or upper end 108. The concrete base pole 102 further defines an outer surface 110 and an inner surface 112 (See FIG. 2), since the concrete base pole 102 is hollow. The concrete base pole 102 has a continuous longitudinal taper along its outside surface 110 such that the outside diameter of the concrete base pole 102 is largest at the bottom end 106, and smallest at the top end 108.

Figure 5:
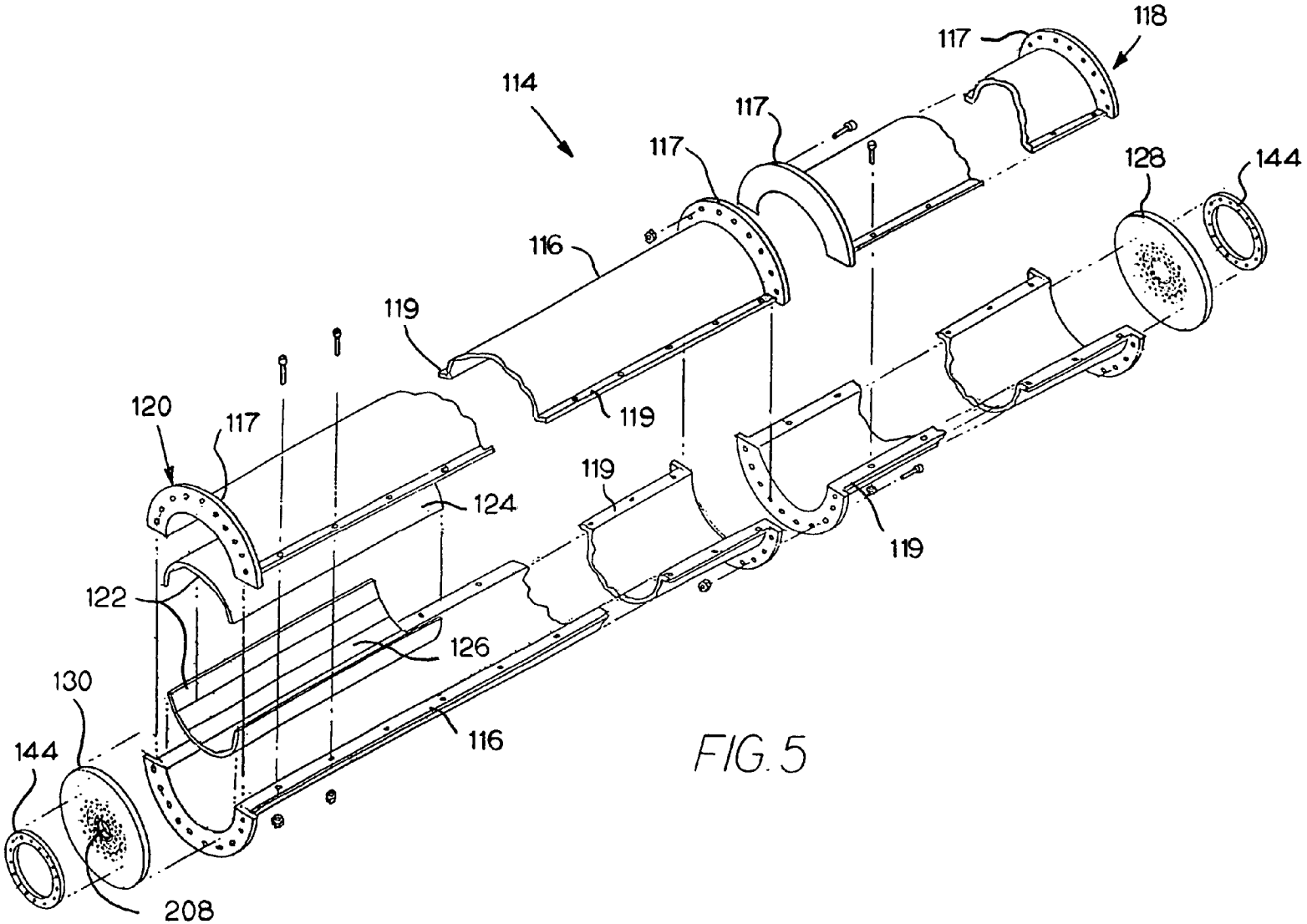
FIG. 5 is a perspective view of the hardware for the centrifugal casting of the concrete pole base of FIG. 1, including an insert for the transition from circular cross-section to a multisided cross-section, as well as the end anchor plates used for prestressing the steel mold.
Figure 5A:
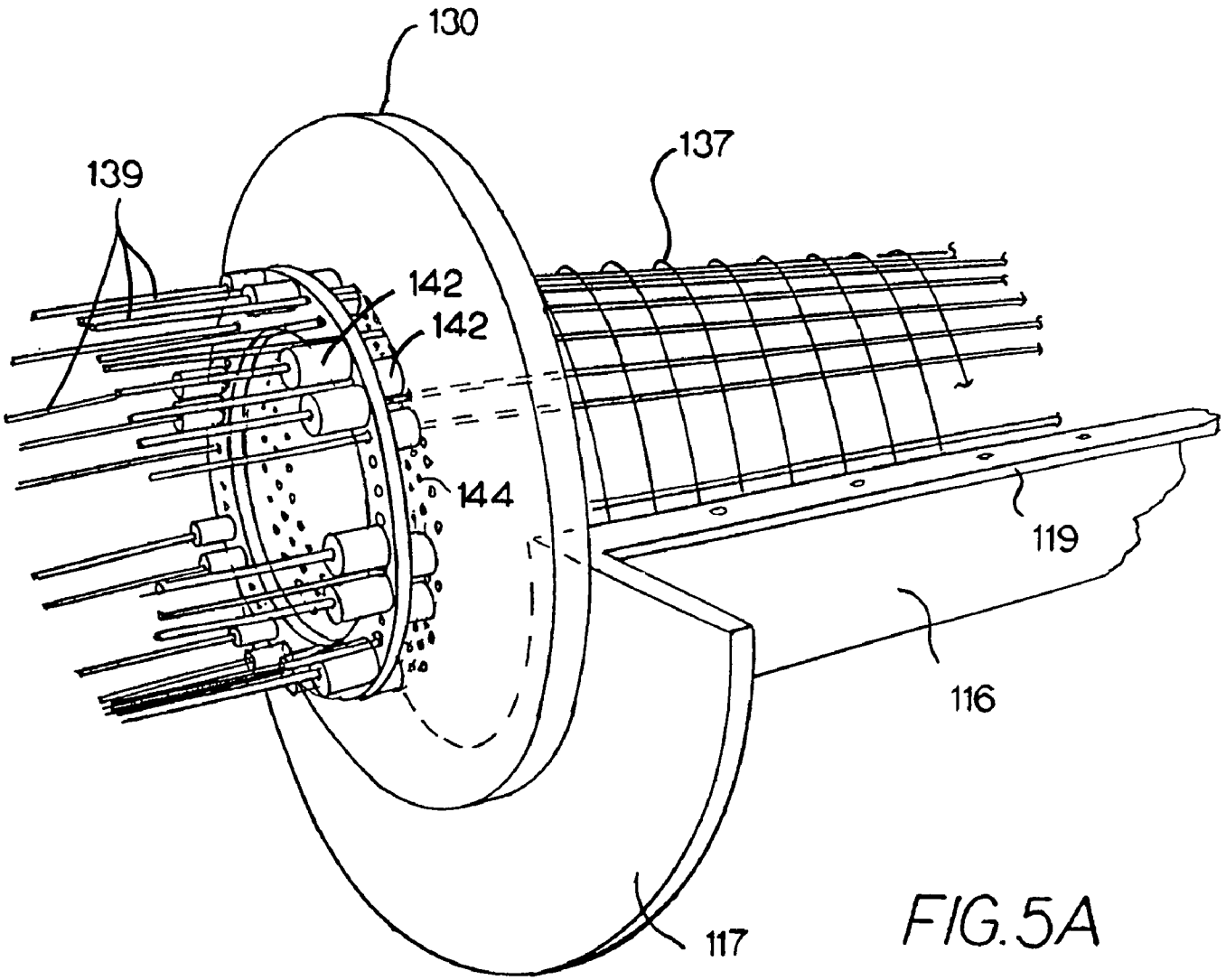
FIG. 5A is an enlarged perspective view of the left end of the mold of FIG. 5, including steel reinforcing strands and cage and the anchor end plate.

The concrete base pole 102 is manufactured by centrifugally casting, using the hardware assembly 114 shown in FIGS. 5 and 5A. This hardware assembly includes two identical semicircular cross-section mold halves 116 which, when assembled, together will form a tapered shape having a circular cross-section, which is wider at the bottom end 118 and narrower at its top end 120. The mold halves 116 (preferably made of steel) are made up in sections, each section having end flanges 117, at both ends, and the abutting end flanges 117 are bolted together to form the full length of the mold. Each mold half 116 also has side flanges 119, and the upper and lower mold halves 116 are bolted together at their side flanges 119 to form the tapered-cylinder mold. Inside the tapered cylindrical shape formed by the two identical semicircular mold halves 116 are two identical semicircular sleeve inserts 122. These semicircular sleeve inserts 122 are substantially shorter than the two semicircular mold halves 116 (in this preferred embodiment the sleeve inserts 122 are approximately 4 feet long), and the sleeve inserts 122 are also of slightly smaller diameter than the mold halves 116 and have the same taper such that, when the sleeve inserts 122 are bolted into the mold halves 116, they fit snugly inside the mold halves 116. The sleeve inserts 122 are mounted at the top end 120 of the respective mold halves 116 such that the upper end of the sleeve inserts 122 is exactly even with the upper end 120 of the cylinder formed by the assembled mold halves 116.

The sleeve inserts 122 have an outer surface 124 and an inner surface 126. In this preferred embodiment, the inner surface 126 defines a multisided, polygonal shape which, in this case, is a dodecagon or twelve-sided figure. End plates 128, 130 lie adjacent to the respective ends 118, 120 of the mold. As shown in FIG. 5A, the reinforcing strands 139 extend through holes 140 in the end plate 130. The same is true of the other end, which is not shown in this view. The reinforcing strands 139 that are tensioned are held in position by chucks 142, and this tension holds the end plates 128, 130 on the ends of the mold. As will be noted in FIG. 5A, an additional ring 144 is located outside the end plate 130 in order to provide sufficient space for all the chucks 142. The additional ring 144 rests on the lower tier of chucks 142. It should also be noted that not all the reinforcing strands 139 are tensioned by the chucks 142. These strands may be post-tensioned, as will be explained below, or they may not be tensioned at all.

The casting assembly 114 is, then, essentially a tapered, cylindrical shape, a multisided insert at the narrow end, and end anchor plates at both ends, which are secured to the cylindrical shape with reinforcing strands 139 extending along the interior of the mold and projecting out at the ends.

Figure 7:
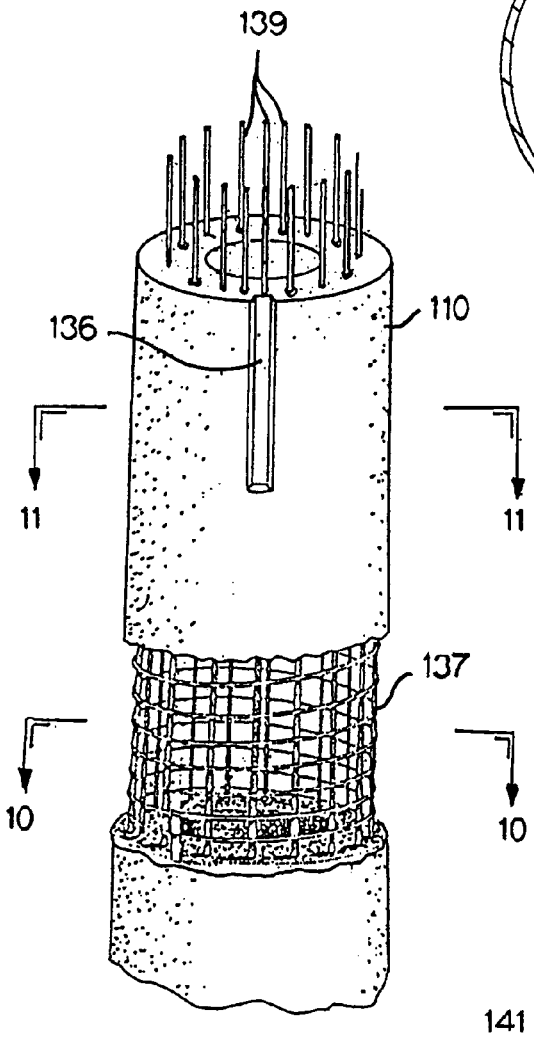
FIG. 7 is a broken away perspective view, partially in section, of the uppermost part of an alternative embodiment of a concrete base pole made in accordance with the present invention, prior to post-tensioning, and including a channel or keyway used to non-rotationally secure the upper pole (not shown) to the concrete pole.

In the manufacture of the centrifugally-cast concrete pole 102, the cage of reinforcing spiral wires and prestressing strands is prepared as is shown in FIGS. 5A and 7. To accomplish this, a coil of reinforcing wire 137 is placed in the lower mold half 116. The end plates 128, 130 are temporarily clamped to their respective end flanges 117 by means of large C-clamps (not shown). Reinforcing strands 139 are then fed through the end plate 130, through the inside of the coil of reinforcing wire 137 which is lying on the mold half 116, and through the other end plate 128, such that the reinforcing strands 139 are extending out past the bottom 118 of the mold half 116, and they are also extending out past the top 120 of the mold half 116. The coil of reinforcing wire 137 is tied with wire ties to the reinforcing strands 139 at intervals along the length of the pole and is stretched out, so that it surrounds the strands 139 from the top 120 to the bottom 118 of the mold half 116, forming a spiral cage around the strands 139, as is known in the art.

Figure 6:
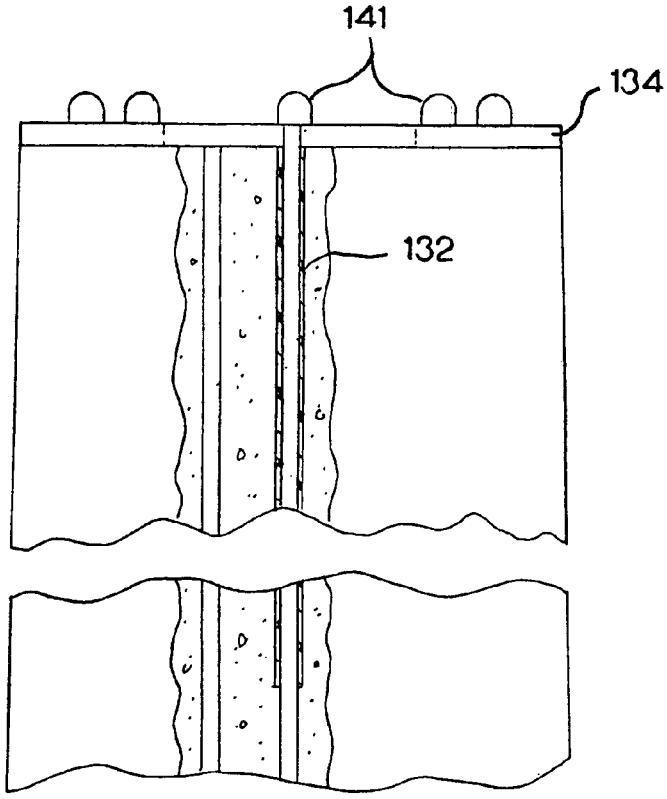
FIG. 6 is a schematic, broken away side view, partially in section, of the top of the concrete base pole shown in FIG. 3, showing both pretensioned and post-tensioned strands.
Figure 11:
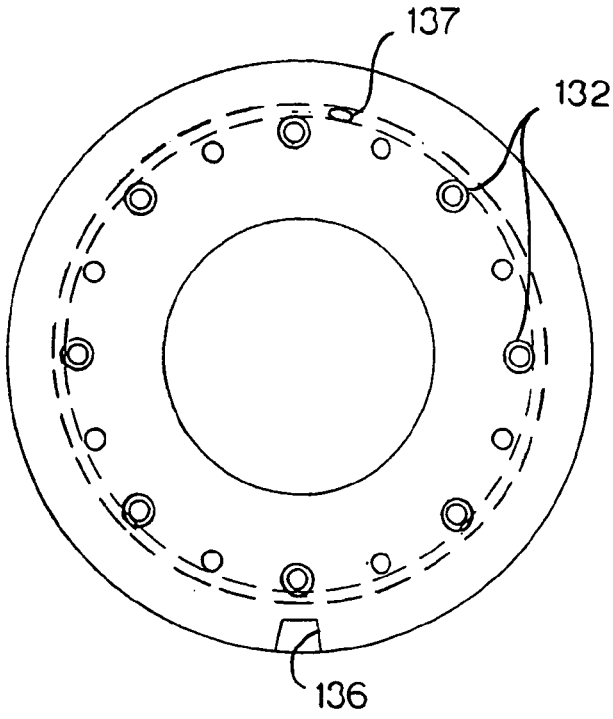
FIG. 11 is a view along section 11-11 of FIG. 7.

The reinforcing strands 139 form a cylindrically-shaped bundle, with each strand 139 extending through its respective opposed holes in the end plates 128, 130. As is best shown in FIGS. 6 and 11, some of the strands 139 have a sheath 132 surrounding the strand starting at the end proximate to the upper end 120 of the mold half 116 and extending for a desired length, such as four or five feet, fifteen feet, or whatever length the designer thinks is desirable for post-tensioning. The sheaths 132 are located at and project out of the narrow end 120 of the mold half 116. The sheaths 132 are preferably made of plastic tubing or other similar material and have an inside diameter which will freely allow the axial movement of the reinforcing strands inside the sheaths 132. The purpose of these sheaths 132 will be explained later. While these drawings show the sheaths 132 on every other strand, the designer may insert the number and arrangement of sheaths as is desired for the proper post-tensioning. However, the sheaths 132 should be placed symmetrically so that the post-tensioning will be uniformly distributed at the end of the pole.

The reinforcing wire 137 (which is now no longer in a coil but is rather in a spiral) is secured to the reinforcing strands at several points along the length of the mold. The end result is a cage, formed of reinforcing strands 139 running lengthwise and inside of a spiral of reinforcing wire 137, with the reinforcing strands 139 and the reinforcing wire 137 being secured to each other (preferably with wire ties) along the length and circumference of the cage.

Once the bottom mold half 116, the end plates 128, 130, and the cage made up of spiral wire 137 and straight strands 139, some with casing 132, is assembled, some of the strands 139 are pre-tensioned (preferably the strands that are not encased by sheaths 132) by fastening one end relative to the mold with a chuck 142, pulling the other end with a certain desired amount of tension, and then fastening the other end relative to the mold using another chuck 142, as is well known in the art. Once the chucks 142 are in place, the tensioning holds the end plates 128, 130 onto the ends of the mold, and the C-clamps (not shown) are removed. Concrete is then placed along the entire length of the mold half 116, through the wire cage, such that the concrete mix fills the trough formed by the mold half 116 and the end plates 128, 130. Additional concrete is placed toward the narrower end 120 of said trough such that the concrete level actually crowns above what would be a full-trough level. The trough is now closed by assembling the other half of the sleeve insert 122 to the upper mold half 116, installing the upper mold half 116 over the lower mold half 116, and bolting the side flanges 119 together.

At this point, there is an entire cylinder assembly consisting of mold halves 116 with sleeve inserts 122, and inside these is a reinforcing strand cage made up of a cylindrical bundle of strands 139, in which some strands have a plastic sheath 132 at the narrower end 120 of the assembly, and a spiral wound reinforcing wire which has been secured to the axially aligned reinforcing strands. Concrete has been placed into the horizontal cylinder assembly so it is approximately half full as the cylinder lies on its side (with its longitudinal axis perpendicular to the force of gravity). End plates 128, 130 have been installed at the first and second ends 118, 120 of the cylinder assembly, and the desired strands 139 have been prestressed.

This entire assembly is then placed on a spinner that rotates the assembly around its longitudinal axis until the concrete material has been evenly distributed by the centrifugal forces along the walls of the assembly, forming an interior void, and the concrete mix has hardened due to consolidation. The centrifugal action will also cause a slight migration of the concrete along the longitudinal axis of the assembly, from the narrower end to the wider end of the tapered cylinder. It is in order to counter the effects of this migration that concrete was placed to a higher level (until it actually crowned over what would be the flush level) in the narrower end of the trough.

The spinning of the assembly around its longitudinal axis accomplishes the centrifugal casting, wherein centrifugal forces acting on the concrete sling the concrete against the walls of the assembly and at the same time compact the concrete, resulting in a denser, stronger concrete than one simply statically poured but not subjected to centrifugal action. The entire assembly is then removed from the spinner and is allowed to remain undisturbed for a desired curing period. Once the concrete has cured sufficiently, the chucks 142 securing the pre-tensioned strands to the end plates 128, 130 are then removed; this releases the steel mold and transfers the tension in the pre-tensioned strands to apply a compression force along the entire length of the concrete pole 102, thus applying the prestress forces to the concrete to increase its load carrying capacity and reduce its susceptibility to cracking.

Figure 8:
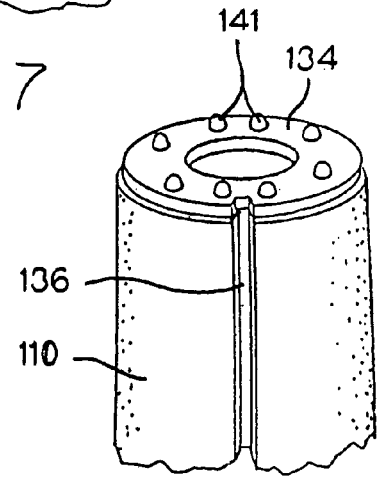
FIG. 8 is a broken away perspective view of the top of the concrete pole section of FIG. 7 after post-tensioning.

Once the end plates 128, 130 have been removed, the mold halves 116 and the sleeve inserts 122 are also removed, and the ends of all pre-tensioned strands (those which did not have a sheath) extending out at the narrow top end 120 of the assembly are cut off. All ends of all the strands extending out the bottom end 118 are cut off. A ring-shaped bearing plate 134 (see FIGS. 3, 6, and 8) is then installed at the upper end of the pole 102, with all ends of the post-tensioning strands 139 (those which have the sheath) sticking out through holes in the circular bolt pattern of the plate 134. The majority of the length of these post-tensioning strands is embedded, and thus secured, in the cured concrete below the sheaths 132. The end of each post-tensioning strand proximate to the narrow end 108 has been encased by the sheath 132 so it is free to move axially, as the sheath 132 has protected and separated the strand from bonding to the concrete. Once the bearing plate 134 is in place, the ends of the encased strands 139 extending out are tensioned with the desired amount of force and secured against the plate 134, using securing devices 141 known in the industry. Thus, the plate 134, pushing against the strands in order to keep said strands in tension, will exert a compression force on the concrete, at the end of the pole that fits inside the upper pole section and that bears the most force from the upper attachment pole section 104. This is also the area of the concrete pole which has the multisided cross-section. This post-tensioning of the concrete at the upper end makes the concrete stronger in this area and capable of resisting the high internal forces that develop when an upper pole 104 is mounted on the concrete base pole 102 and is subjected to external loads.

As may be understood by anyone skilled in the art, the specific configuration of the reinforcing cage, the number, relationship, and ratio of sheathed-to-unsheathed strands, and the pre-tensioning and post-tensioning forces applied, if any, may vary, depending on the specific requirements and design calculations of the application. While the bearing plate 134 is shown here as a single plate, it could also be made in various configurations, such as providing a smaller, individual plate for each strand to be post-tensioned, for example.

Figure 4:
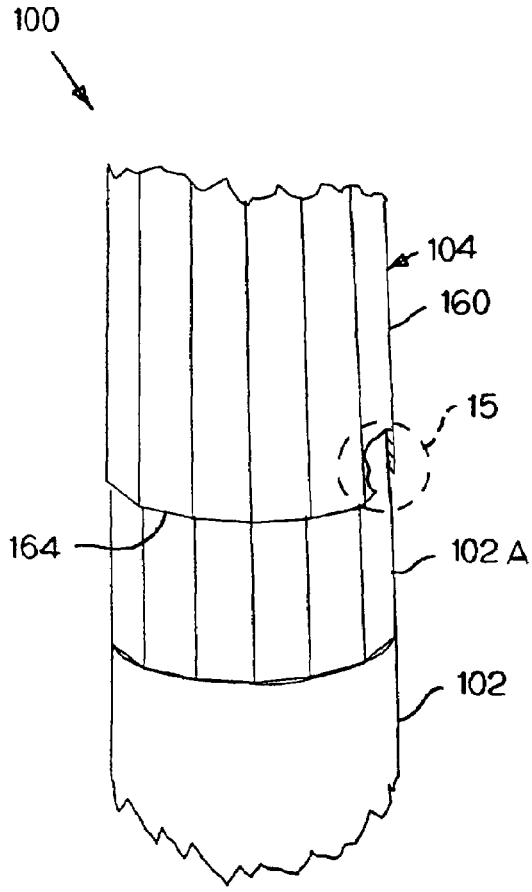
FIG. 4 is a broken away side view of the transition section of the assembled pole of FIG. 1, showing a hollow multi-sided steel pole telescopically mounted over the multi-sided upper portion of the concrete base, with the bottom part of the steel pole partially in section.
Figure 3:
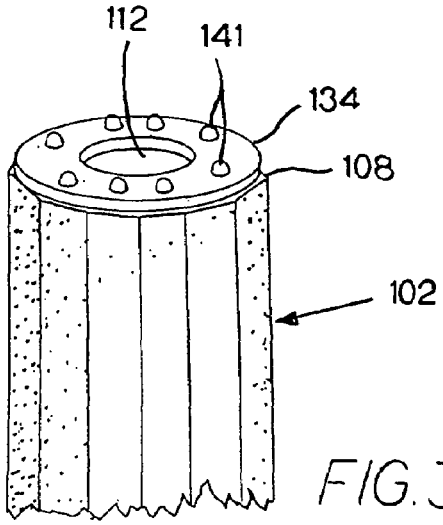
FIG. 3 is an enlarged, broken away perspective view of the top of the concrete pole section of FIG. 2 after a steel bearing plate has been inserted and post-tensioning of strands has been applied.

FIG. 4 shows a broken-away portion of a pole 100 at the bottom of the upper hollow pole portion 104. It can be seen in this view that the cross-section of the concrete base pole 102 in its upper portion has a multi-sided polygonal shape and corresponds with the cross-section of the hollow upper pole 104, so that the upper pole 104 readily telescopes over the lower pole 102. The upper portion of the base pole 102 and the lower portion of the upper pole 104 are tapered so that, as the upper pole 104 is lowered onto the base pole 102, it reaches a position in which there is a tight fit between the upper pole 104 and the base pole 102. At that point the upper pole 104 stops, leaving a strip 102A of the multi-sided portion of the concrete pole that is not encased by the upper pole 104. The mating polygonal shapes of the upper pole 104 and base pole 102 prevent the pole portions from rotating relative to each other.

Figure 15:
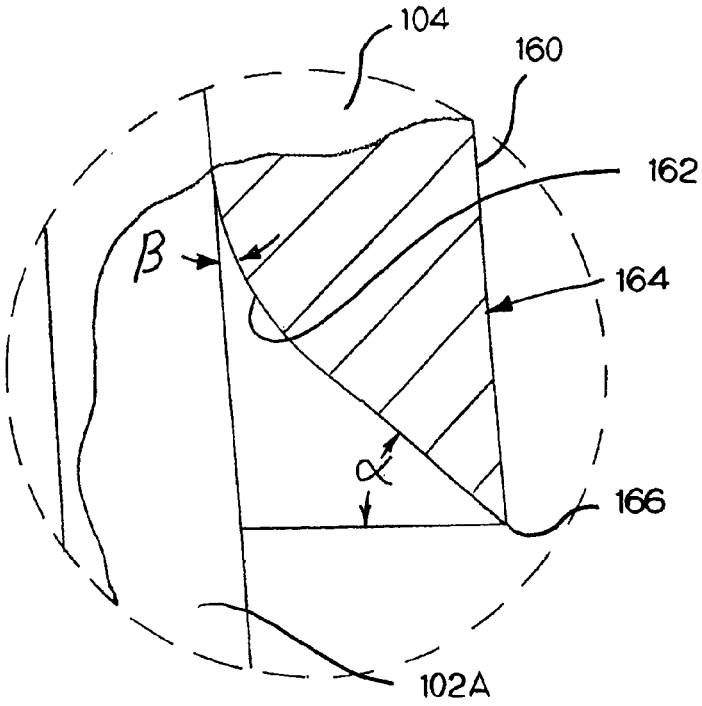
FIG. 15 is an enlarged view of the detail area 15 of FIG. 4.

FIG. 15 shows an enlarged, detailed view of the area 15 encircled in FIG. 4, in which the upper metal pole section 104 is shown partially in section. The wall of the metal pole 104 is shown to include an outer surface 160, and an inner surface 162. The end portion 164 of the metal pole 104, which slides over the concrete base 102, includes a chamfer on its inner surface 162, having a rounded contour. The inner surface 162 of the bottom portion 164 of the metal pole 104 preferably is curved in a substantially parabolic shape, so that it is tangent to the substantially vertical concrete base wall in the area where it contacts the concrete base and then curves away from the concrete base at an increasing angle. In this case, the angle a at the bottom end of the inner surface 162 is approximately 45° from a line perpendicular to the wall of the concrete base, which means that it is also approximately 45° from the substantially vertical wall of the concrete base 102A, while the angle β where the curved surface 162 approaches the wall of the concrete base 102A is substantially less than 45°. This shape may be achieved by making a double chamfer or by other known means. This rounded chamfer provides a smooth side to slide and rest against the concrete base 102A, so there are no sharp edges to cut into the concrete base 102A, which could weaken the concrete base 102A. By protecting the concrete base 102A against being cut by the upper pole 104, the concrete base is not weakened, and therefore can support the applied design loads. This curved shape also shifts the inner surface of the bottommost edge 166 of the metal pole outwardly as much as possible, making it easy to slip the metal upper pole portion 104 over the concrete base 102A.

Figure 9A:
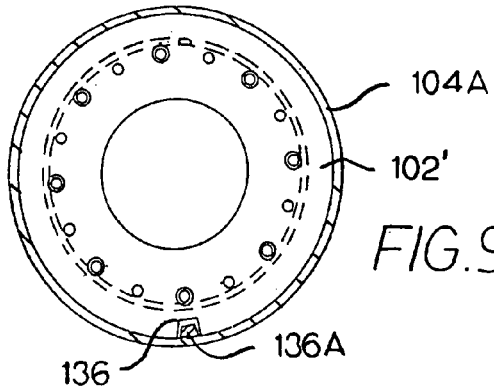
FIG. 9A is a section taken along the line 9A-9A of FIG. 9.

FIGS. 7-9A show an alternate embodiment of the present invention. In this embodiment, the transition from circular cross-section base pole to multisided cross-section upper pole is achieved by the upper pole 104'. The tapered concrete base pole 102' has a circular cross-section throughout its full length. At the top of the concrete pole 102', and extending axially downwardly along one side of the outer surface 110 of the concrete pole 102', is a groove or keyway 136. The upper pole 104' has a projection 136A on its inner surface that serves as a key, which is received in the keyway 136 to prevent the upper pole from rotating relative to the lower pole, as shown in FIG. 9A. If the upper pole 104' is made of metal, the key may be a metal bar that is welded in place. If the upper pole 104' is made of fiberglass, the projection may just be a molded part of the pole. The key is of such dimensions that it will slide into and fit snugly into the keyway 136. The upper pole 104' is first aligned with the concrete base pole 102' such that the key 136A attached to the inner surface of the upper pole 104' is lined up with the corresponding keyway 136 in the concrete pole 102'. The upper pole 104' is lowered onto the base pole 102' until it reaches a position in which there is a tight fit between the upper pole 104' and the base pole 102'. The key 136A and keyway 136, acting cooperatively, provide a positive alignment of the upper pole 104' and the base concrete pole 102', and further will not allow for rotation of the upper pole 104' relative to the concrete pole 102' once the two poles have been mated.

Figure 9:
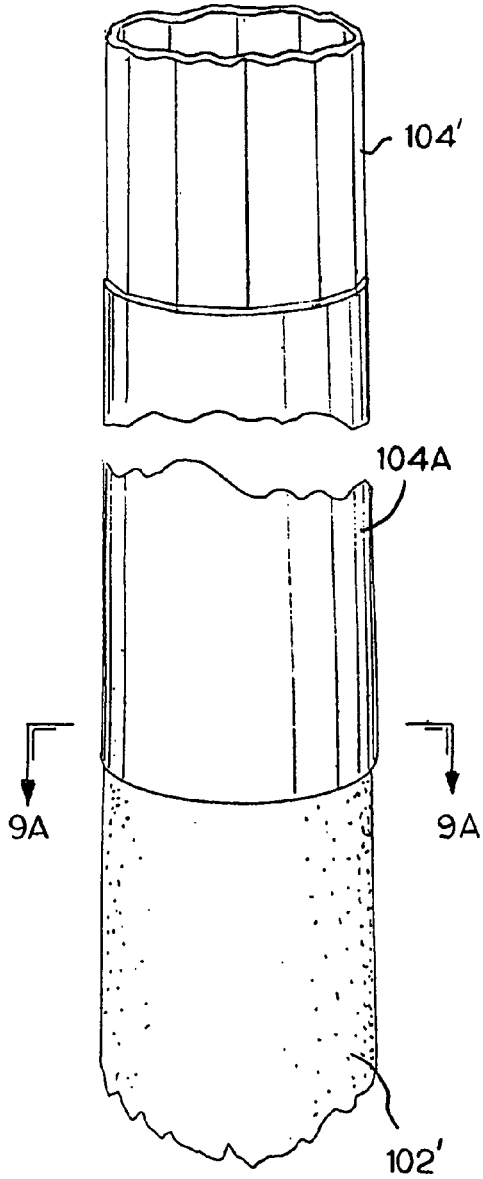
FIG. 9 is a broken-away, perspective side view of a multi-sided pole, having a circular cross-section bottom portion, mounted over the concrete base of FIG. 8.
Figure 10:
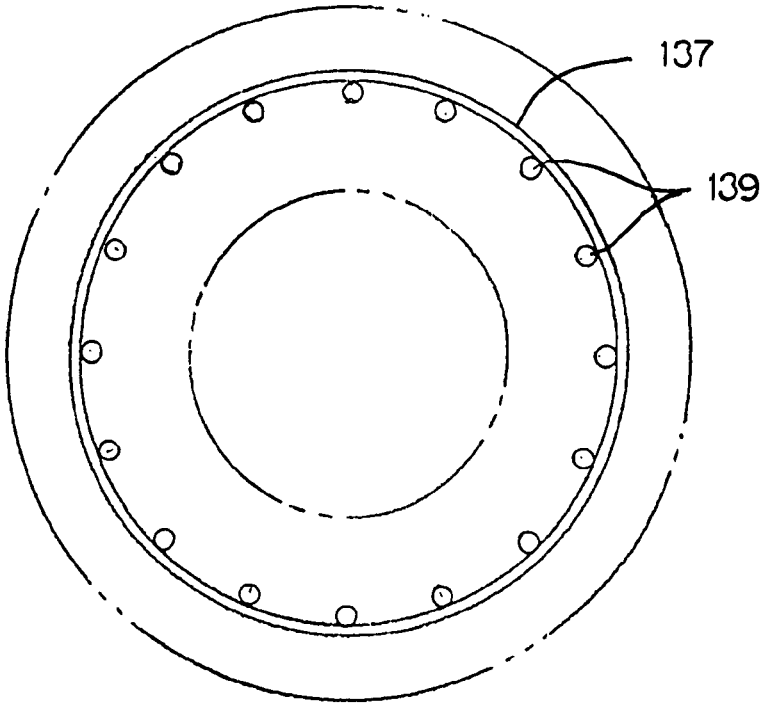
FIG. 10 is a view along the section 10-10 of FIG. 7.

FIG. 9 shows a broken-away portion of the upper pole 104', which fits over the base pole 102'. The upper pole 104' has a hollow multisided polygonal cross-section in its upper portion and a transition to a hollow circular cross-section 104A in its lower portion, which conforms to the shape of the concrete base 102'.

Figure 12:
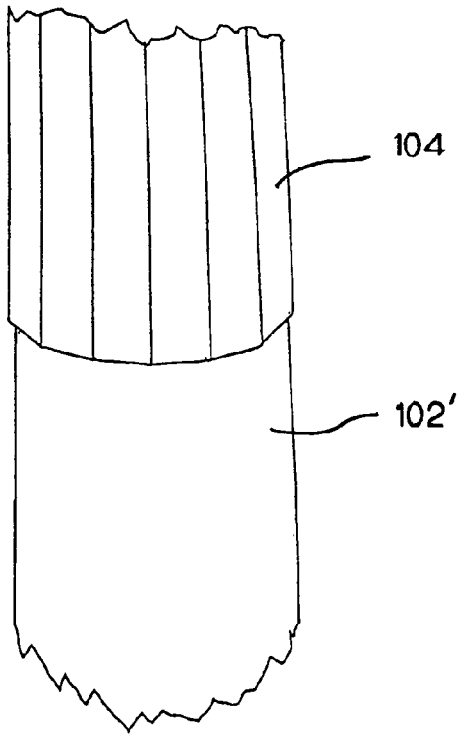
FIG. 12 is a broken away side view of another embodiment of the present invention, wherein a multisided cross-section pole is being mounted onto a circular-cross-section concrete pole.

FIG. 12 shows another alternative embodiment. In this embodiment, the lower pole 102' has a circular cross-section from top to bottom as in FIGS. 7-9A, and the upper pole 104 has a multi-sided polygonal (i.e. 12-sided) cross-section from top to bottom as in the first embodiment. The upper pole 104 in this embodiment must be made of a deformable material, such as metal. In this case, the hollow upper pole 104 is lowered onto the base pole 102' until it reaches a position in which there is a tight fit between the upper pole 104 and the base pole 102'. The upper pole 104 is then forced further down over the concrete base pole 102', resulting in a friction fit and a distortion of the multisided cross-section of the upper pole 104 in the area where it is contacting the concrete pole 102', such that the multisided cross-section of the upper pole 104' becomes rounded. Essentially, the upper pole 104 is being deformed and re-shaped by the lower concrete pole 102' due to jacking of the two parts together and, as it does so, the cross-sectional profile of the lower portion of the upper pole 104' adopts the more circular cross-sectional profile of the concrete pole 102', so that it approaches the shape shown in FIG. 9. This friction fit between the lower concrete pole 102' and the upper pole 104 will not allow for rotation of the upper pole 104 relative to the concrete pole 102' once the two poles have been mated.

Figure 13:
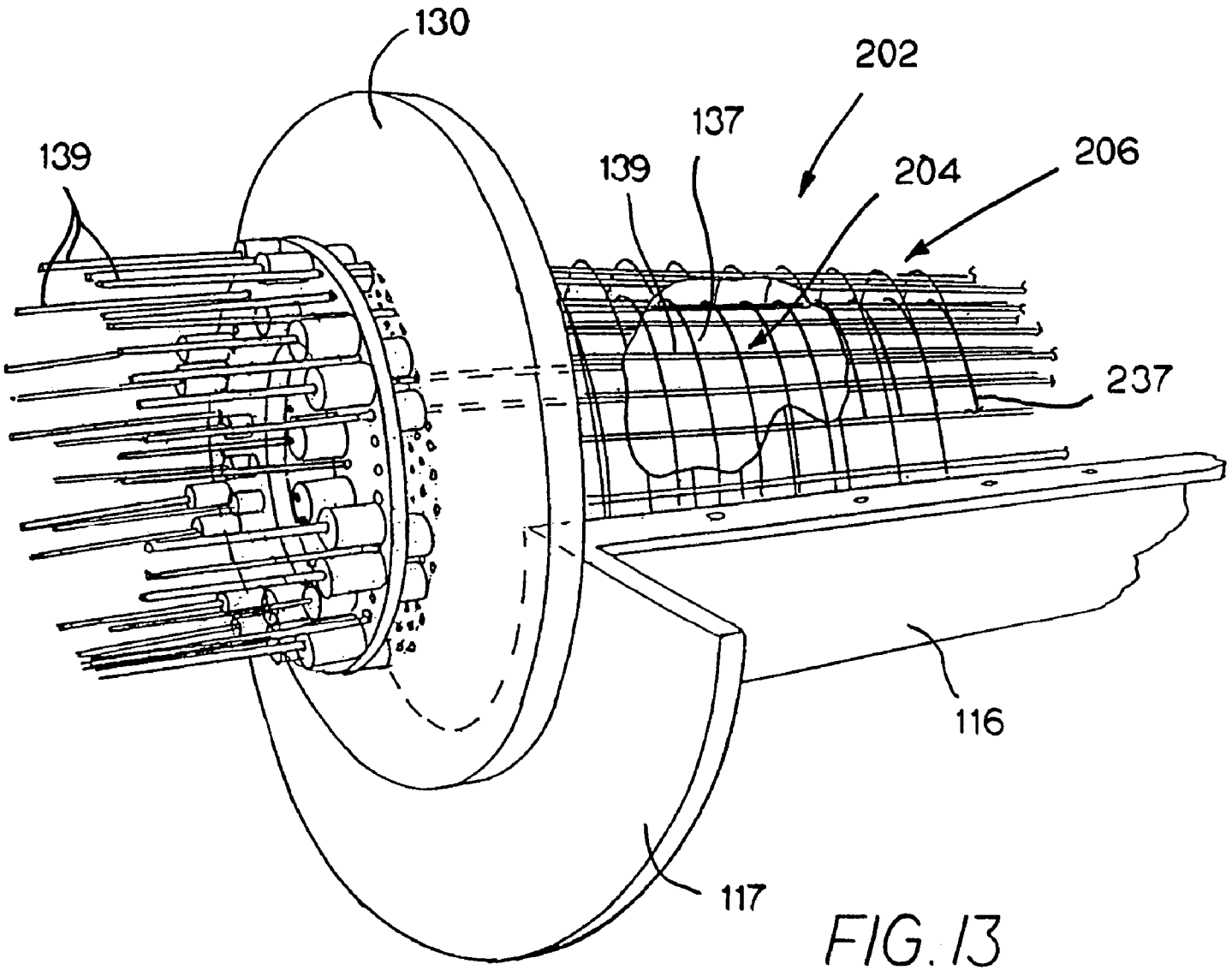
FIG. 13 is a perspective view of the left end of the mold, similar to the view of FIG. 5A, except that it is for yet another embodiment of the present invention, showing two sets of reinforcing strands and cages and an end plate.
Figure 14:
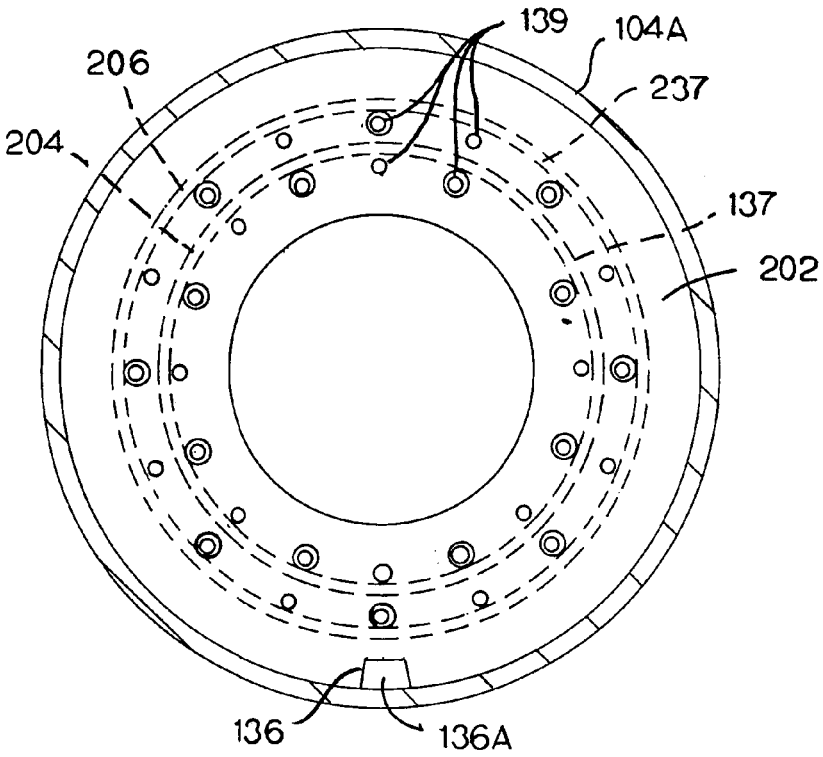
FIG. 14 is a view, similar to that of FIG. 11, but for the double cage embodiment depicted in FIG. 13.

FIGS. 13 and 14 show yet another embodiment for a concrete base 202 of the present invention. In this embodiment, the concrete base 202 is made stronger in order to handle higher structural loadings. This is accomplished by a combination of additional reinforcing steel embedded in the centrifugally cast concrete base 202, and a thicker cast concrete wall. In order to physically accommodate the additional reinforcing steel, a second cage 204 is added inside the first cage 206.

In the manufacture of the centrifugally-cast concrete pole 202, the inner cage 204 of reinforcing wires and prestressing strands is prepared very much in the same manner as has already been described with reference to the first embodiment 102, as is shown in FIGS. 5A and 7. Namely, a coil of reinforcing wire 137 is placed in the lower mold half 116. However, in addition, a second, larger diameter coil of reinforcing wire 237 is also placed in the same lower mold half 116, surrounding the first coil 137. The purpose of this second coil 237 will be explained shortly. The end plates 128, 130 are temporarily clamped to their respective end flanges 117 by means of large C-clamps (not shown). Two sets of elongated reinforcing strands 139, extending in the lengthwise direction of the pole, are then fed through the end plate 130, through the inside of their respective coils of reinforcing wire 137, 237, and through the other end cap 128, as was explained earlier. Each coil of reinforcing wire 137, 237 is stretched out and tied to its respective elongated reinforcing strands 139, forming inner and outer cages 204, 206. As was described earlier, and as best shown in FIGS. 6 and 11, some of the strands 139 have a sheath 132 surrounding the strand starting at the end proximate to the upper end 120 of the mold half 116 and extending for a desired length, for post-tensioning. The sheaths 132 project out the narrow end 120 of the mold half 116. While these drawings show the sheaths 132 on every other strand, the designer may insert the number and arrangement of sheaths as is desired for the proper post-tensioning. However, the sheaths 132 should be placed symmetrically so that the post-tensioning will be uniformly distributed at the end of the pole. Once the bottom mold half 116, the end plates 128, 130, and the cages 204, 206 made up of spiral wires 137, 237, and their respective straight strands 139 are assembled, some of the strands 139 are pre-tensioned as described earlier. At this point in the manufacturing process, the inner cage 204 lies suspended inside the outer cage 206, as shown in FIGS. 13 and 14.

Once the chucks 142 are in place, the tensioning holds the end plates 128, 130 onto the ends of the mold, and the C-clamps (not shown) are removed. Concrete mix is then placed along the entire length of the mold half 116, through the wire cages 204, 206, such that the concrete mix fills the trough formed by the mold half 116 and the end plates 128, 130. Additional concrete mix is placed toward the narrower end 120 of said trough such that the concrete level actually crowns above what would be a full-trough level. The trough is now closed by assembling the other half of the sleeve insert 122 to the upper mold half 116, installing the upper mold half 116 over the lower mold half 116, and bolting the side flanges 119 together.

This entire assembly is then placed in a spinner that rotates the assembly around its longitudinal axis until the concrete has been distributed by the centrifugal forces along the walls as described earlier. Immediately after an initial spin cycle, which is usually a few minutes, the wall thickness is measured. If the measured cast concrete wall thickness is short of the targeted wall thickness, then additional concrete is added to the assembly via an opening 208 (See FIG. 5) in the second, narrower end 120 of the cylinder assembly 114 and is spread out as evenly as possible in the first section of the mold 116. The entire assembly is then spun a second time for a few minutes at full rpm, and then it is spun a third time for an additional few minutes at ⅔ of full rpm. Upon completion of this third spinning cycle, the wall thickness is checked once again to ensure that the actual wall thickness is within the desired tolerance. As an example, the first spin may take ten minutes, and the second and third spins may each take five minutes.

As described earlier, the entire assembly is then removed from the spinner and is allowed to remain undisturbed. Thereafter, the pre-tensioned strands may be released from their chucks and cut off, and the strands within sleeves may be post-tensioned as described earlier. The procedure for using this heavier-wall-thickness cast concrete base 202 is similar to that described for the original cast concrete base 102 of the first embodiment, including the procedure for post-tensioning, if required, with the only added complexity being that there are now more strands. This heavier-walled concrete base 202, with its more extensive metal reinforcing, results in a structurally stronger concrete base.

While a 12-sided polygonal shape has been shown here as a preferred embodiment, other similar shapes could be used, such as a six-sided (hexagon), eight-sided (octagon), ten-sided, twelve-sided, 18-sided, or other polygons. Also, the casting methods and reinforcement arrangements shown here may be used for other cross-sectional shapes of poles as well, such as for a base that has a circular cross-section throughout its height. It will be obvious to those skilled in the art that many other modifications may be made to the embodiments described above without departing from the scope of the present invention.

What is claimed is:

1. A method for forming a concrete pole comprising the steps of:

placing a plurality of first elongated reinforcing strands into a mold defining an upper end and a lower end and an axis, and tying said first elongated reinforcing strands to a first spiral strand surrounding the first elongated reinforcing strands;

inserting a first charge of wet concrete into said mold;

spinning said mold about its axis thereby slinging said concrete outwardly to form a compact outer wall with a hollow interior;

stopping the spinning and measuring the wall thickness;

adding additional wet concrete into said hollow interior; and spinning said mold about its axis again.

2. A method for forming a concrete pole as recited in claim 1, and further comprising the step of placing a plurality of second elongated reinforcing strands into said mold outside the first plurality of strands and tying said second elongated reinforcing strands to a second spiral strand surrounding the second elongated reinforcing strands prior to inserting said first charge of wet concrete into said mold.

3. A method for forming a concrete pole as recited in claim 2, and further comprising the step of tensioning some of said strands prior to spinning said mold.

4. A method for forming a concrete pole as recited in claim 3, and further comprising the steps of encasing some of said elongated strands in casings for part of their length adjacent to the upper end of the mold prior to inserting the wet concrete; allowing said wet concrete to dry after said spinning again; and tensioning said encased elongated strands after said wet concrete has dried.

* * * * *